United States Patent [19]

Heinen et al.

[11] Patent Number: 4,809,491

[45] Date of Patent: Mar. 7, 1989

[54] PLASTIC TRAVELER FOR SPINNING RINGS, TWISTING RINGS AND THE LIKE

[75] Inventors: Helmut Heinen; Burkhard Nimke, both of M/e,uml/o/ nchen-Gladbach; Helmut Nickolay, Uhingen, all of Fed. Rep. of Germany

[73] Assignee: Reiners & Fürst and Zinzer, Mönchen-Gladbach, Fed. Rep. of Germany

[21] Appl. No.: 150,886

[22] Filed: Feb. 1, 1988

[30] Foreign Application Priority Data

Jan. 30, 1987 [DE] Fed. Rep. of Germany ..... 8701450
Jul. 11, 1987 [DE] Fed. Rep. of Germany ..... 3723057

[51] Int. Cl.[4] ..... D01H 7/60

[52] U.S. Cl. ..... 57/125; 57/78; 57/264

[58] Field of Search ..... 57/119, 125, 264, 265, 57/75, 78, 81

[56] References Cited

U.S. PATENT DOCUMENTS

| | | | |
|---|---|---|---|
| 1,717,642 | 6/1929 | Wentworth | 57/264 |
| 1,834,874 | 1/1931 | Schaff | 57/125 X |
| 2,930,179 | 3/1960 | Bailey | 57/75 |
| 2,968,908 | 1/1961 | Morin | 57/125 |
| 4,023,342 | 5/1977 | Schenkel | 57/75 X |
| 4,028,873 | 6/1977 | Schulz et al. | 57/78 X |
| 4,656,822 | 4/1987 | Meissner | 57/78 X |
| 4,676,056 | 6/1987 | Nickolay et al. | 57/75 X |

*Primary Examiner*—Donald Watkins
*Attorney, Agent, or Firm*—Herbert L. Lerner; Laurence A. Greenberg

[57] ABSTRACT

A traveler for spinning rings, twisting rings and the like includes a plastic part with a given mass and a metal part having at most the given mass. The metal part is disposed on the plastic part at a point facing away from the axis of the ring.

12 Claims, 1 Drawing Sheet

FIG. 1
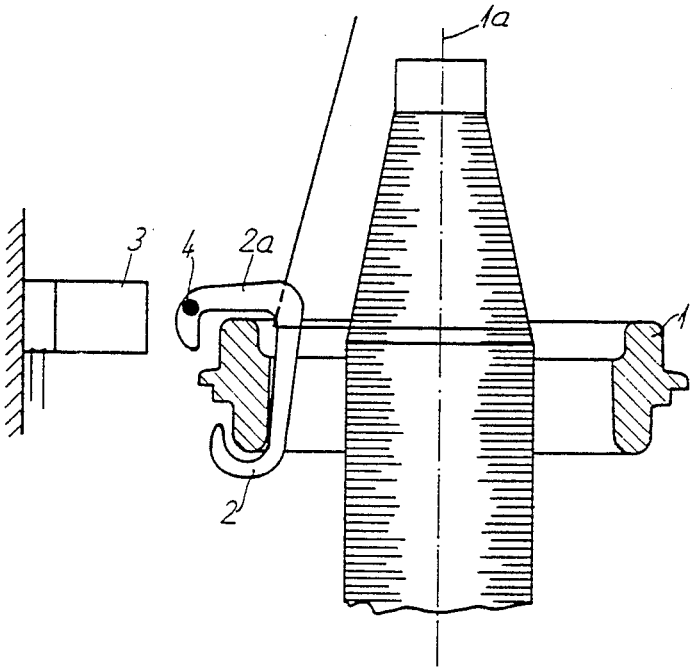
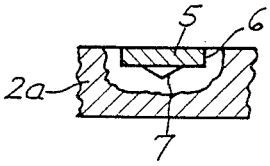
FIG. 2

PLASTIC TRAVELER FOR SPINNING RINGS, TWISTING RINGS AND THE LIKE

The invention relates to plastic travelers for spinning rings, twisting rings and the like.

In order to monitor roving breakage or yarn breakage when metal travelers are used, it is known to move the revolving traveler past a sensor. If the traveler speed drops below a predetermined level, the sensor interrupts the feeding of the roving or yarn and/or interrupts the spindle drive and thus shuts down the spinning or twisting station. Inductive feelers having an electrical oscillating circuit that oscillates at a predetermined frequency which changes as the traveler moves past the feeler and is then electronically processed further, have been used heretofore as sensors. However, this monitoring method is only usable in machines that use metal travelers, which are capable of affecting the inductive feeler. In many instances, however, plastic travelers which preferably made of nylon, are used. These plastic travels are intrinsically incapable of affecting inductive feelers.

Attempts have therefore been made in such a case to use an optical sensor having a beam light which is broken by the revolving traveler upon each revolution, and to monitor the spindle drive in this manner. This method has proved unsuccessful in the textile industry, in which there is a great deal of dust, because the lenses become soiled and then emit incorrect signals.

It is accordingly an object of the invention to provide a plastic traveler for spinning rings, twisting rings and the like, which overcomes the hereinafore-mentioned disadvantages of the heretofore-known devices of this general type and which monitors roving breakages even when using travelers made of plastic.

With the foregoing and other objects in view there is provided, in accordance with the invention, a plastic traveler for spinning rings, twisting rings and the like, comprising a plastic part with a given mass, and a metal part having at most the given mass, the metal part being disposed on the plastic part at a point facing away from or remote from the axis of the ring.

Although providing nylon travelers with a metal part is known, the metal part according to the prior art is disposed at the point where the yarn travels through the traveler, in order to increase the wear resistance of the nylon part. Such travelers are unsuitable for monitoring traveler rotation by means of inductive feelers, because the influence of the metal part on the inductive feeler is insufficient as a consequence of the great distance between them. Accordingly, reliable signals are not attainable.

Lengthening the metal part in order to bring it nearer the operative vicinity of the inductive feeler entails dynamic difficulties. The function of a traveler for spinning and twisting rings and the like is known to depend very substantially upon the weight thereof. For this reason it is highly important to make the mass which is brought to bear for the response of the inductive feeler as small as possible.

In accordance with another feature of the invention, the metal part has a mass being less than one-half of the given mass. It has been found that the function of plastic travelers is only negligibly affected in this way.

The more influence the metal part is capable of having on the inductive feeler, the smaller its mass can be. For this reason, in accordance with a further feature of the invention, the metal part is formed of iron or an iron alloy. The iron or iron alloy metal part can, for example, be installed at the time that the plastic traveler is cast, in the form of iron powder disposed over a large surface area, at a point remote or facing away from the ring axis of the traveler.

Depending upon the shape of the traveler, that is, whether it is an ear-shaped or C-shaped traveler, in accordance wtih an added feature of the invention, the metal part is in the form of a ball. This has proved advantageous because a ball has the most favorable concentration of mass for processing puposes.

On the other hand, for various reasons, the metal ball cannot be made arbitrarily small. In such cases, in accordance with an additional feature of the invention, the metal part is in the form of a hollow ball.

In accordance with yet another feature of the invention, the metal part is a small metal plate and is disposed in a corresponding recess formed in the plastic part.

In accordance with yet a further feature of the invention, the plastic part has an outer contour, the recess is a blind bore, and the small metal plate is flush with the outer contour.

In accordance with yet an added feature of the invention, the plastic part has an additional central depression formed therein continuous with the blind bore for receiving a droplet of glue.

In accordance with a concomitant feature of the invention, the small metal plate is circular.

Other features which are considered as characteristic for the invention are set forth in the appended claims.

Although the invention is illustrated and described herein as embodied in a plastic traveler for spinning rings, twisting rings and the like, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 1 is a fragmentary, diagrammatic, partly cross-sectional elevational view of a spinning or twisting ring according to the invention on a bobbin or cop; and FIG. 2 is an enlarged, fragmentary, partly broken-away cross-sectional view of another embodiment of the bracket of the invention.

Referring now to the figures of the drawings in detail and first, particularly, to FIG. 1 thereof, there is seen a spinning or twisting ring 1 and the axis 1a thereof. A nylon traveler 2, which is constructed in the form of an ear-shaped traveler in the illustrated embodiment, revolves on the spinning ring. An inductive feeler 3 is associated with the orbit of the nylon traveler and is subject to the influence of a metal part 4 disposed in an upper bracket **2*a* of the traveler 2. In principle, the metal part 4 could also be disposed in the lower bracket of the traveler 2, at a point remote from the ring axis 1a**, if the inductive feeler can be brought near enough to the orbit of the metal part.

FIG. 2 shows another embodiment of the bracket **2*a* on a larger scale, in which a small metal plate 5 is inserted into a blind bore 6. The small plate 5** can be secured by means of press-fitting. However, the plate can also be glued into place. In that case it is advantageous to provide an indentation 7, which can accommodate any excess glue.

We claim:

1. Traveler for spinning rings, twisting rings and the like, comprising a plastic part with a given mass, and a metal part having at most said given mass, said metal part being disposed on said plastic part at a point facing away from the axis of the ring.

2. Traveler according to claim 1, wherein said metal part has a mass being less than one-half of said given mass.

3. Traveler according to claim 1, wherein said metal part is formed of iron.

4. Traveler according to claim 1, wherein said metal part is formed of an iron alloy.

5. Traveler according to claim 1, wherein said metal part is in the form of a ball.

6. Traveler according to claim 4, wherein said metal part is in the form of a hollow ball.

7. Traveler according to claim 1, wherein said metal part is a small metal plate and is disposed in a corresponding recess formed in said plastic part.

8. Traveler according to claim 7, wherein said plastic part has an outer contour, said recess is a blind bore, and said small metal plate is flush with said outer contour.

9. Traveler according to claim 8, wherein said plastic part has an additional central depression formed therein continuous with said blind bore for receiving a droplet of glue.

10. Traveler according to claim 7, wherein said small metal plate is circular.

11. Traveler according to claim 8, wherein said small metal plate is circular.

12. Traveler according to claim 9, wherein said small metal plate is circular.

* * * * *